US012024999B2

(12) United States Patent
Bonderover et al.

(10) Patent No.: US 12,024,999 B2
(45) Date of Patent: Jul. 2, 2024

(54) TELEMETRY REPLAY

(71) Applicant: MS Directional, LLC, Conroe, TX (US)

(72) Inventors: Eitan Bonderover, Sugar Land, TX (US); Libo Yang, Houston, TX (US); Charles W. Davis, Jr., Cleburne, TX (US); Shyam B. Mehta, Missouri City, TX (US)

(73) Assignee: MS DIRECTIONAL, LLC, Conroe, TX (US)

( * ) Notice: Subject to any disclaimer, the term of this patent is extended or adjusted under 35 U.S.C. 154(b) by 0 days.

(21) Appl. No.: 17/848,489

(22) Filed: Jun. 24, 2022

(65) Prior Publication Data

US 2023/0193747 A1 Jun. 22, 2023

Related U.S. Application Data

(60) Provisional application No. 63/290,319, filed on Dec. 16, 2021.

(51) Int. Cl.
*E21B 47/12* (2012.01)

(52) U.S. Cl.
CPC ..... *E21B 47/12* (2013.01)

(58) Field of Classification Search
CPC ..... E21B 47/12; E21B 47/125; E21B 47/13; E21B 47/135; E21B 47/138; E21B 47/14; E21B 47/16; E21B 47/18; E21B 47/20; E21B 47/22; E21B 47/24; E21B 47/26
See application file for complete search history.

(56) References Cited

U.S. PATENT DOCUMENTS 8,255,767 B2 * 8/2012 Akimov ..... G01V 11/002 714/748
8,312,346 B2 * 11/2012 Budin ..... H03M 13/612 714/755

OTHER PUBLICATIONS

"Mark IV Decoding Software is Unstoppable!", YouTube, (Jul. 20, 2021), [retrieved on Apr. 28, 2023] Retrieved from the Internet <https://www.youtube.com/watch?v=8bq6vvnFKOM>.

* cited by examiner

*Primary Examiner* — Franklin D Balseca
(74) *Attorney, Agent, or Firm* — Jackson Walker LLP

(57) ABSTRACT

The present disclosure provides a method and system for supplemental processing of recorded historical data in real time to fill in gaps of lost data. A user who may be monitoring the data from human interfaces can immediately recognize an issue, quickly change one or more settings for parameters (including changing one or more of the parameters), and replay for reprocessing the recorded data to provide a revised output that can catch up to the processing of later current data without needing to halt operations. In at least one field of use, the invention can eliminate the need for restarting a complete drilling process to resynchronize the surface system when the system is not able to demodulate a valid bitstream, saving time and maintaining high drilling efficiency.

24 Claims, 9 Drawing Sheets
(3 of 9 Drawing Sheet(s) Filed in Color)

TELEMETRY REPLAY

CROSS REFERENCE TO RELATED APPLICATIONS

This application claims the benefit of U.S. Provisional Application No. 63/290,319, filed Dec. 16, 2021, entitled "Telemetry Replay", which is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to telemetry and processing telemetry signals. Specifically, the disclosure relates to telemetry and retrieval of at least some of the telemetry data that is lost due to changing or noisy environments in which the communication channel is operating.

Description of the Related Art

Telemetry has been defined as the science and technology of automatic measurement and transmission of data by wire, radio, or other means from remote sources to receiving stations for recording and analysis. Telemetry is practiced in many environments from below the earth in oilfield transmissions from downhole instruments to environments above the earth from space vehicles. The telemetry is typically transmitted from a sending unit to a receiving station for data processing and output that is needed for operational guidance or input.

FIG. 1 is a schematic example of a system using telemetry to communicate data from a downhole tool in a well bore to a receiving station at the surface. An oil rig 34 generally is used to drill a hydrocarbon well 35 to establish a wellbore 36. A drill string 37 of pipe and tooling is progressively inserted into the wellbore as drill bits progressively deepen the wellbore. A mud pump 38 pumps mud through an inlet conduit 39 into a standpipe attached to the oil rig to a flexible high-pressure hose to the drill string 37 to travel downward through the drill string and through a downhole telemetry tool 40 with a modulator and a Bottom Hole Assembly (BHA) 41 with a drill bit to help flush cuttings from the drill bit. The mud pressure causes the mud and cuttings to return up an annulus between the larger wellbore and the small drill string to the surface and into a return conduit 42. The mud flows over a screen to separate larger particles and returns to the mud pit 43. In oil field operations for Measurements While Drilling (MWD) services, various measurements data acquired downhole is sent from the downhole telemetry tool 40 that aggregates data and sends using various telemetry methodology such as mud-pulse telemetry, electromagnetic telemetry, and others. For many mud-pulse methods, the telemetry tool 40 generates pressure pulses in the mud by controlled intermittent blocking and unblocking of mud flowing through the telemetry tool. A related process is Logging While Drilling (LWD). The MWD and/or LWD can be generally referred to herein as MLWD. The downhole telemetry tool 40 is typically an MLWD tool in an MLWD system that can transmit measurement data via telemetry pulses to an uphole receiving station 102 coupled to a pressure sensor in the standpipe that senses the change in pressure of the mud pulses. The receiving station 102 generally includes a processor for extracting the telemetry data. Current MLWD methodology using mud telemetry depends on the mud flowing in the stand pipe and actively circulating in a drilling column circuit between downhole and surface locations. The telemetry is typically sent in sequences. The order of the data sent uphole in any of the sequences is predetermined based on the sequence identifier word preceding the sequence data.

FIG. 2 is an illustrative block diagram of a current system of the acquired pressure data from the standpipe pressure sensor described in FIG. 1. The downhole telemetry tool generates pressure pulses based on the data stream to send to the surface in the mud-pulse telemetry. At the surface, the pressure transducer as a sensor mounted on the standpipe senses the pressure pulses, superimposed typically with some noise that travels through the drill string and converts the pulses in an analog electrical signal representing the pressure variations or waveform. This analog electrical signal is formed from the pressure pulses created by the downhole telemetry tool. This analog signal is further processed by signal conditioning and filtering to remove some of the noise and enhance signal frequency bandwidth. Further, the signal is digitized. More filtering is applied to the digitized data stream to remove more noise introduced in the telemetry channel. This relatively clean signal is demodulated with various techniques known in the industry to generate the digital bitstream of data which was originally sent by the downhole telemetry tool. Usually in the stages of the filtering and demodulation, some initial settings are input in the software by a user based on the previous experiences from the similar well conditions.

For telemetry to work properly, the surface system needs to identify the start of the telemetry signal at the beginning, generally when the pumps are turned on and the flow is stabilized. At the start of the telemetry, the telemetry tool will send a known pattern of pulses or waveform, known as a synchronization (SYNC) pattern. This step is well recognized by the surface system demodulation processing software and now the system can start to accurately decode the following digital bitstream in the measurement samples. When demodulating the signal in some surface systems, the processing software will generate the Signal to Noise Ratio (SNR) corresponding to the demodulated bit. A low SNR indicates a high-level confidence in the bit value being correct. If the SNR is high, the confidence of this bit value is low. The low confidence for bits in a data would result in low confidence in the value of the sample with which the bits are associated.

There are number of other unwanted pressure artifacts superimposed on the pressure pulses created by the telemetry tool. These other pressure artifacts are in general characterized as noise in the telemetry communication channel. Examples of some of the noise sources are acoustic reflection, mud pumps, drill bits, variations in flow rates, various equipment in the BHA such as an agitator and a mud motor, and others that can generate additional fluctuations in the pressure wave. Further, some noise sources are injected in the electrical signal created by the pressure transducer, for example, AC power frequency induced in the transmission line or noise caused by heavy electrical equipment on the rig site turning ON and OFF. These noises often make generating the correct digital bitstream very difficult. In some cases due to the noise, the surface system does not even recognize the SYNC pattern, and therefore does not start the decoding and completely misses decoding the data stream unless later intervention by the user occurs.

FIG. 3 is a representative chart of a field data showing a signal amplitude drop condition. Sometimes, after recognizing the SYNC pattern properly and demodulating a good bitstream, a sudden drop in the mud pressure signal level occurs. The surface system may be unable to recognize the signal, because the signal level has dropped as well. In this case, the drilling may continue while a user diagnoses the problem and as a result some section of drilling data is lost.

As shown in the FIG. 3, recorded data is shown from the time 0 to 2500 seconds. The stepped graph line applicable to the Y-axis scale on the right side represents the Stand Pipe Pressure (SPP) in Pounds per Square Inch (PSI). The circles represent the received mud-pulse heights at given times as processed by the surface computer. The Y-axis scale on the left side shows the height of the pressure pulses in PSI. These pulses were generated by the telemetry tool.

At about 250 seconds, the pump is turned ON as evidenced by the increasing SPP. In all the pressure pulses after the SPP is high enough, the surface computer is searching for the predefined specific SYNC pattern that the telemetry tool must send first. Once the SYNC pattern is detected, at about 300 sec. mark, the surface computer with the current settings such as pulse height threshold, detects the subsequent pulses and demodulates good bitstream and data samples until about 750 sec. mark. At 750 sec. the SPP for unknown reason is increased and at the same time the pulse heights received by the surface computer is lowered. One of the possibilities is that the telemetry tool pulser may have been obstructed partially or it could be due to a BHA component, such as an agitator, was activated.

As a result, the peak of the pressure pulses after 750 sec. mark was not recognized. One of the settings, in this case the pressure threshold, was too high for the resulting lower pulse height condition.

The process must completely restart, as described above, to reset the data stream modulation properly, thus losing time and decreasing drilling efficiency. As a result, the drilling process has to stop. The drill bit is raised from the bottom of the hole. Mud pumps have to be turned OFF and then ON again, and hope that the surface system will recognize the SYNC pattern and resume the drilling process. This restart is very time-consuming process and inefficient. Further, there may be some drilling that has already occurred by the time the problem is identified and the data for that section of depth of the well is typically lost.

While the above background uses mud pulse telemetry as an example of a frequently used process, telemetry data can also be sent via other modes including electro-magnetic telemetry, acoustic telemetry, wired drill pipe telemetry, and others. The lost data issues arises with these and other methodologies, as well. Thus, the invention described herein can apply to at least all modes of telemetry described above.

Therefore, there remains a need to compensate for the loss of data under such conditions in real time that enable operations to continue and receive the guidance that such data can provide.

BRIEF SUMMARY OF THE INVENTION

The present disclosure provides a method and system for supplemental processing of recorded historical data in real time to fill in gaps of lost data. A user who may be monitoring the data from human interfaces can immediately recognize an issue, quickly change one or more settings for parameters (including changing one or more of the parameters), and replay for reprocessing the recorded data to provide a revised output that can catch up to the processing of later current data without needing to halt operations. In at least one field of use, the invention can eliminate the need for restarting a complete drilling process to resynchronize the surface system when the system is not able to demodulate a valid bitstream, saving time and maintaining high drilling efficiency.

Data loss due to these and many similar abnormal conditions in the circulating mud channel environment can be retrieved by storing the analog or digitized waveform of the pressure pulses or waveform from past time and reprocessing and demodulating with enhanced and slightly different settings. This reprocessing can be initiated for example by a user, such as an operator or field engineer, at any instance either at the beginning of the telemetry or anywhere in-between where the loss of data is seen. The invention in some embodiments can be automatic or require very little time and effort from the user. For example, the reprocessing software can make selections of settings and enhanced techniques automatically based on the type of disturbed condition observed from the raw data. The automation can make a very easy, transparent, and efficient process for the user. In some embodiments, the reprocessing software can allow the user to select or modify the setting for the reprocessing or replay of the raw pressure data. The invention here is described using many examples and references mostly from the mud-pulse telemetry but in principle, it is applicable to many other oil-field related telemetry in use and in other fields where using real time telemetry data transfer, including space.

This improvement will allow better data recovery in the mud-pulse telemetry with very little interaction of the user. The input to this enhanced software is the digitized raw pressure waveform information received from the circulating mud channel and the modified settings information to reprocess and demodulate the data. The outcome will be good data which was lost before. Examples of the types of telemetry equally applicable to electro-magnetic, acoustic, wired drill pipe, and others.

The disclosure provides a method of providing telemetry data, comprising: receiving a downhole telemetry analog signal from at least one sensor coupled to a well; processing the analog signal into a digitized data stream; recording at least one of the analog signal and the digitized data stream as recorded data; processing the digitized data stream into a processed telemetry bitstream data; replaying a portion of the recorded data for at least one of an identified telemetry bitstream data loss in the telemetry bitstream data; and reprocessing the portion of the recorded data to provide a data fill of the telemetry bitstream data loss in real time.

The disclosure also provides a method of providing telemetry data, comprising: receiving a downhole telemetry analog signal from at least one sensor coupled to a well; processing the analog signal into a digitized data stream; processing the digitized data stream into a first processed telemetry bitstream data with a first set of parameter settings; and processing the digitized data stream into a second processed telemetry bitstream data with a second set of parameter settings having at least one parameter setting different than the first set of parameter settings.

The disclosure further provides a telemetry data system, comprising: a processor; and a non-transitory computer readable medium including processor executable instructions that, when executed, cause the telemetry data system to perform operations, comprising: receiving a downhole telemetry analog signal from at least one sensor coupled to a well; processing the analog signal into a digitized data stream; recording at least one of the analog signal and the digitized data stream as recorded data; processing the digitized data stream into a processed telemetry bitstream data; replaying a portion of the recorded data for an identified telemetry bitstream data loss in the telemetry bitstream data; and reprocessing the portion of the recorded data to provide a data fill of the telemetry bitstream data loss in real time.

The disclosure provides a telemetry data system, comprising: a processor; and a non-transitory computer readable medium including processor executable instructions that, when executed, cause the telemetry data system to perform operations, comprising: receiving a downhole telemetry analog signal from at least one sensor coupled to a well; processing the analog signal into a digitized data stream; processing the digitized data stream into a first processed telemetry bitstream data with a first set of parameter settings; and processing the digitized data stream into a second processed telemetry bitstream data with a second set of parameter settings having at least one parameter setting different than the first set of parameter settings.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
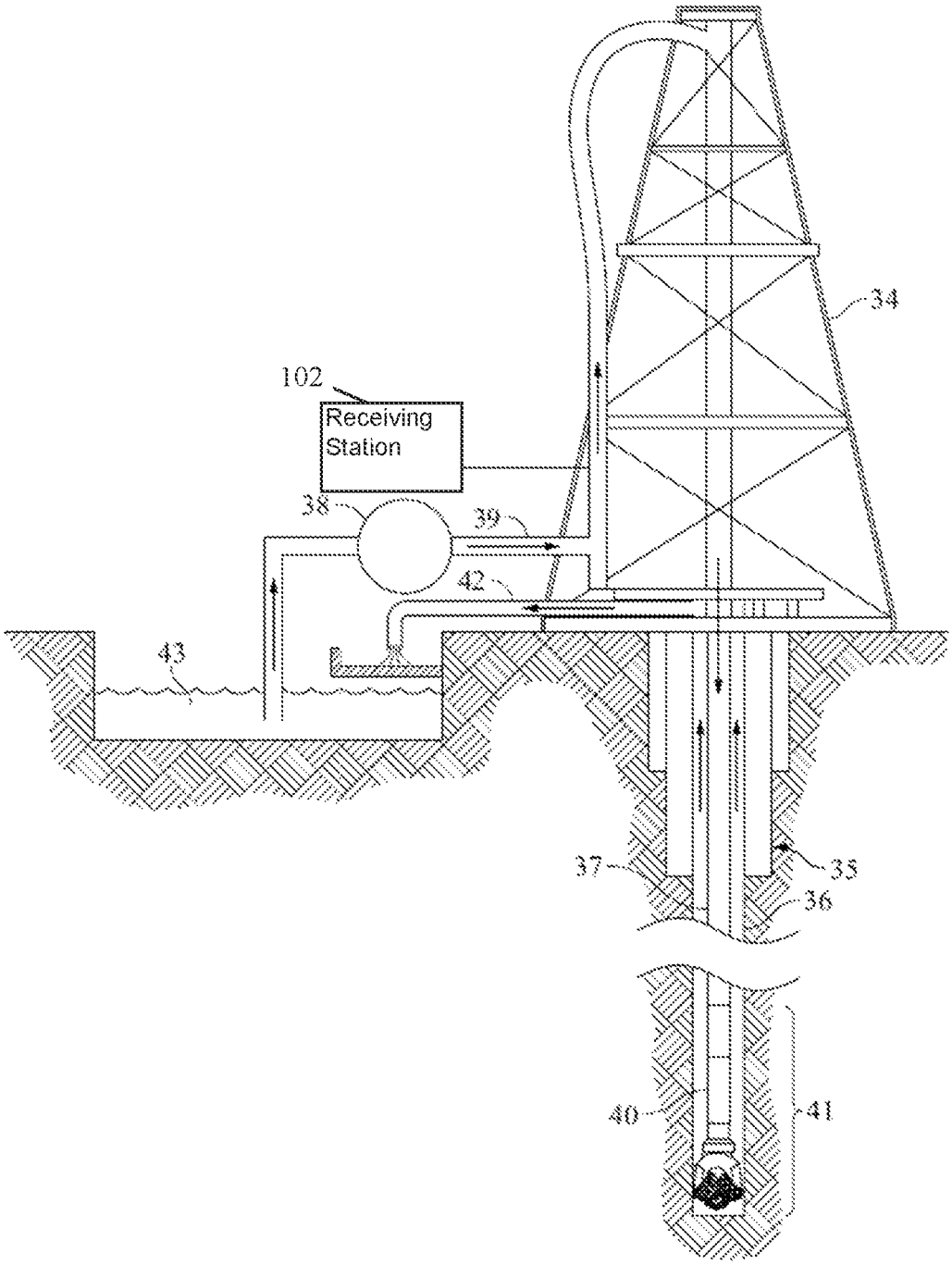
FIG. 1 Prior Art
FIG. 1 is a schematic example of a system using telemetry to communicate data from a downhole tool in a well bore to a receiving station at the surface.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation or location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally. The device or system may be used in a number of directions and orientations. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section, such as a controller would encompass a processor and a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. The term "software" herein is meant to be interpreted broadly to include electronic process instructions and therefore firmware.

The present disclosure provides a method and system for supplemental processing of recorded historical data in real time to fill in gaps of lost data. A user who may be monitoring the data from human interfaces can immediately recognize an issue, quickly change one or more settings for parameters (including changing one or more of the parameters), and replay for reprocessing the recorded data to provide a revised output that can catch up to the processing of later current data without needing to halt operations. In at least one field of use, the invention can eliminate the need for restarting a complete drilling process to resynchronize the surface system when the system is not able to demodulate a valid bitstream, saving time and maintaining high drilling efficiency.

Figure 2:
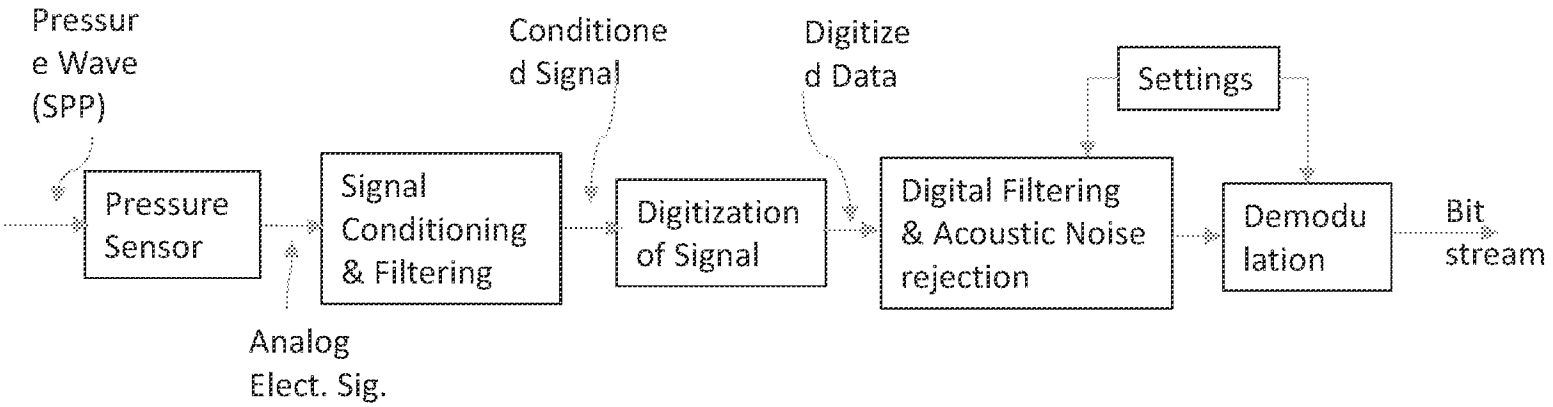
FIG. 2 Prior Art
FIG. 2 is an illustrative block diagram of a current system of the acquired pressure data from the standpipe pressure sensor described in FIG. 1.
Figure 3:
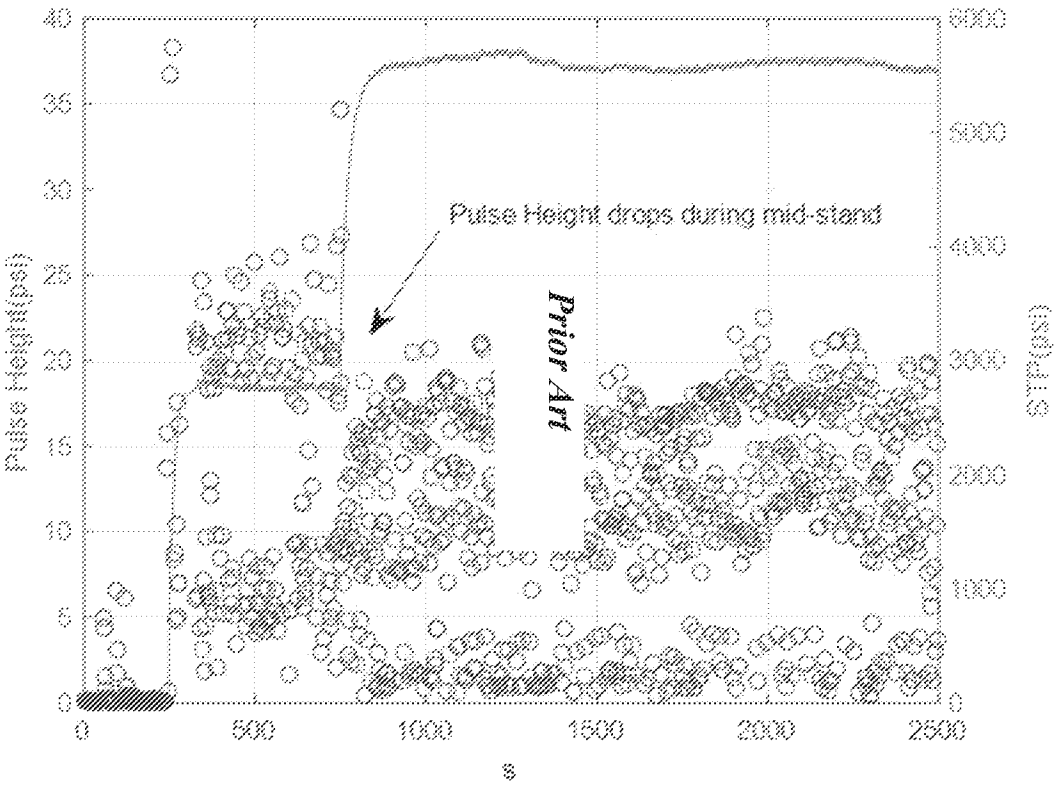
FIG. 3 Prior Art
FIG. 3 is a representative chart of a field data showing a signal amplitude drop condition.
Figure 4A:
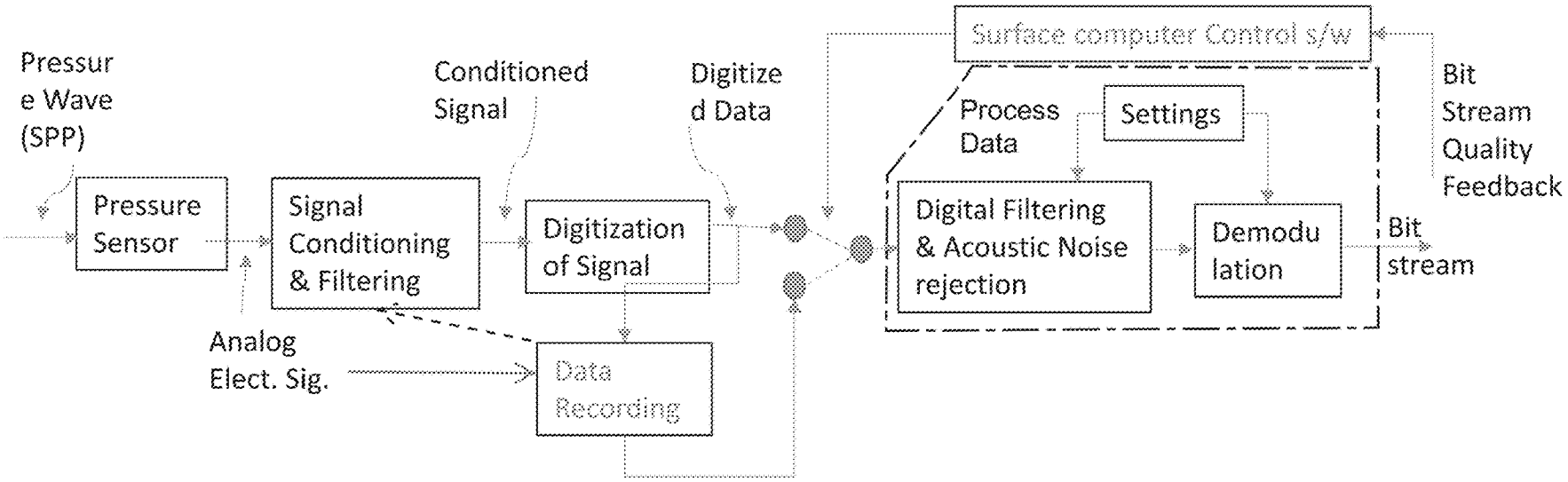
FIG. 4A is an example of a block diagram of an embodiment of the invention illustrating the improvement over the typical system in FIG. 2.

FIG. 4A is an example of a block diagram of an embodiment of the invention illustrating the improvement over the typical system in FIG. 2. The description in FIG. 2 of the system general operation can be applied to FIG. 4A that includes the improvements described herein.

In FIG. 4A, at least one of the analog signal and digitized data are recorded in the surface computer memory with an appropriate time association or timestamp. In at least one example of an operational scenario, based on recognition in the surface software that the pumps are turned on and the Standpipe Pressure (SPP) is high, the SYNC pattern should be but is not recognized by the time it should have been, resulting in a data loss. The surface computer software then analyses the recorded data. If digital data is available, the software can readjust the settings and replay (that is, reprocess) the digitized data from the time it last had a proper telemetry demodulation outputting good bitstream data. If digital data is not available and the analog signal recording is available, the software can direct the appropriate time stamped analog signal to be reprocessed into the digitized data and then reprocessed for the telemetry bitstream data. Alternatively, the software can choose the analog signal instead of the digitized data, or choose both for comparison before sending the replayed data to be processed into the telemetry bitstream data.

Thus, if the SYNC pattern is not recognized, the system can recreate the lost data. This process of signal processing and demodulation can run many times faster than the real-time creation of normal bitstream data into a final output. Processing the replayed data takes just a few seconds for the resulting samples, and the system can return to a normal mode of processing the digital data that continues to occur in real-time.

As another scenario, if the telemetry synchronization is lost in the middle of a demodulation cycle, after the first SYNC subsequent to pumps being turned ON, essentially the same process can be followed to recover the data loss. The surface computer software can search backward in the recorded data for the SYNC pattern, which is sent periodically by the telemetry tool and reprocess the needed data to recreate the lost data samples. The process eliminates the typical need to return to the first SYNC pattern detected after the pumps were turned ON. The above examples related to the SYNC pattern are nonlimiting and other times and needs for reprocessing the data can occur.

As described above, the computer software can recognize and replay to recover the lost data, but in the instance it is not successful, there is an option for the user to take control and select the various settings manually and try to recreate the data samples from the recorded data.

Figure 4B:
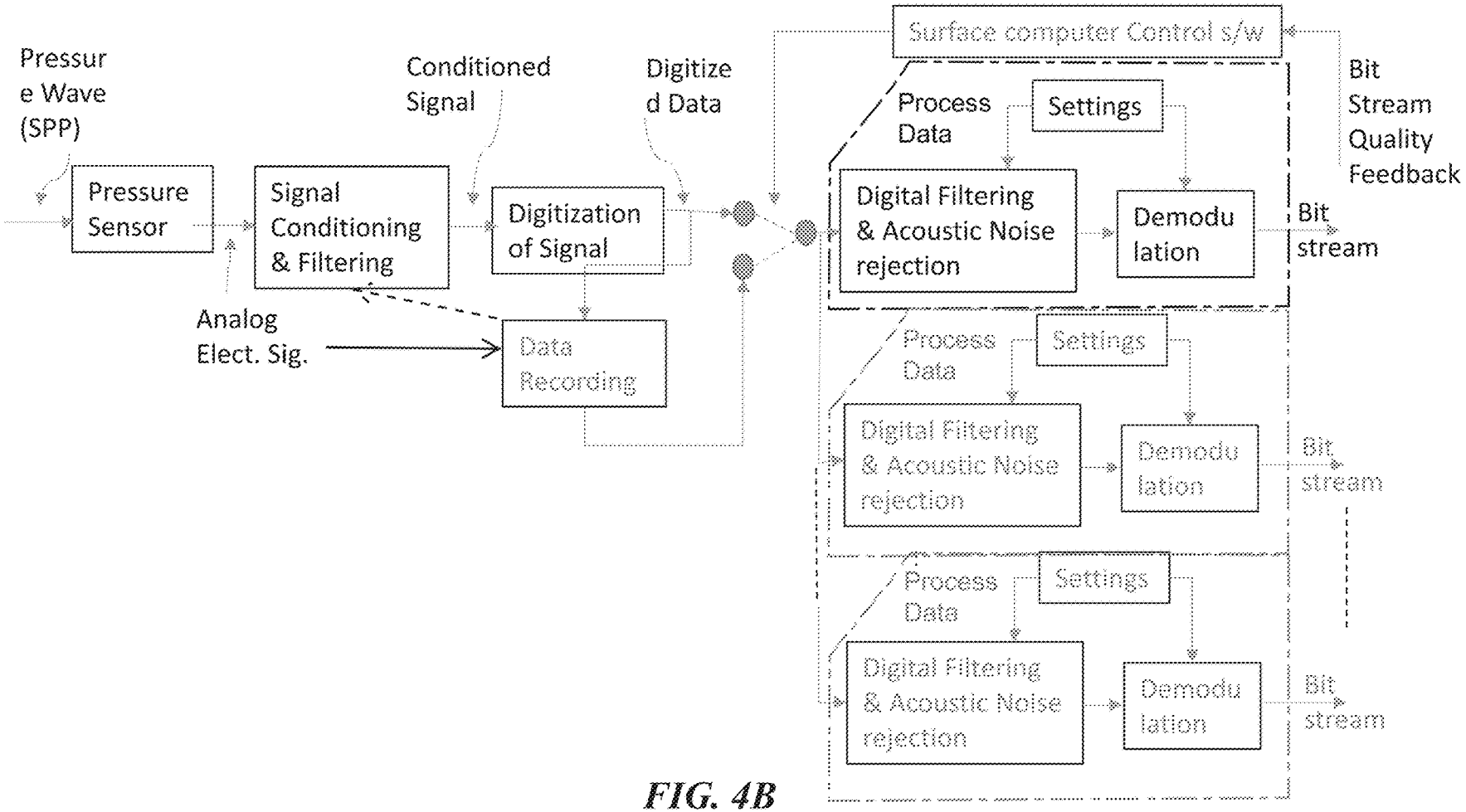
FIG. 4B is an example of a block diagram of another embodiment for multiple channels of the invention illustrating the improvement over the typical system in FIG. 2.

FIG. 4B is an example of a block diagram of another embodiment for multiple channels of the invention illustrating the improvement over the typical system in FIG. 2. The invention can include multiple channels of processed data of "Filtering & Noise Rejection and Demodulation" ("FNRD"). The multiple channels feature is in contrast to the typical single channel system shown in FIG. 2 and the improved system shown in FIG. 4A for a single channel. The multiple FNRD channels can be run in parallel with different settings of parameters, different choices of parameters, and/or different algorithms. The multiple channels can generate multiple telemetry bitstreams based on the same digital data obtained from the pressure transducer in real-time and in Replay mode, but generally with different parameters and/or same parameter(s) with different settings. With multiple bitstreams with attached confidence levels, various types of arbitration software or combination thereof can decide which bitstream is likely the most reliable. Alternatively, various types of arbitration software or combination thereof can be used to decide, for example, by using the highest confidence bit or a bit value where the highest number of channel output agrees. In some embodiments, a preferred bitstream can be chosen and any lost data in the bitstream be replaced with bitstream portions from another channel for that portion, such as a portion that has a higher confidence level. Advantageously, high performance multicore central processing units and high density of memory can be used to run the multiple channels in parallel.

Running multiple channels with slightly different settings can reduce the need for Replay and the recorded data, because some of the different settings can be easily executed in parallel in real-time. Thus, the data may be recorded primarily for archival purposes, because the multiple channels may be sufficient to produce good telemetry bitstream data. However, even with the multiple channels with predetermined various settings, there may be enough variations in noise characteristics and unique communications medium that Replay with the recorded data may still be necessary to recover the lost data.

The invention further contemplates a combination of FIGS. 4A and 4B, in that multiple channels can process the data in FIG. 4A as well, wherein at least two channels have at least one different parameter setting. If a replay is needed such as due to data loss, then multiple channels can reprocess the retrieved recorded data to fill the data loss, wherein at least two channels have at least one different parameter setting.

Figure 5:
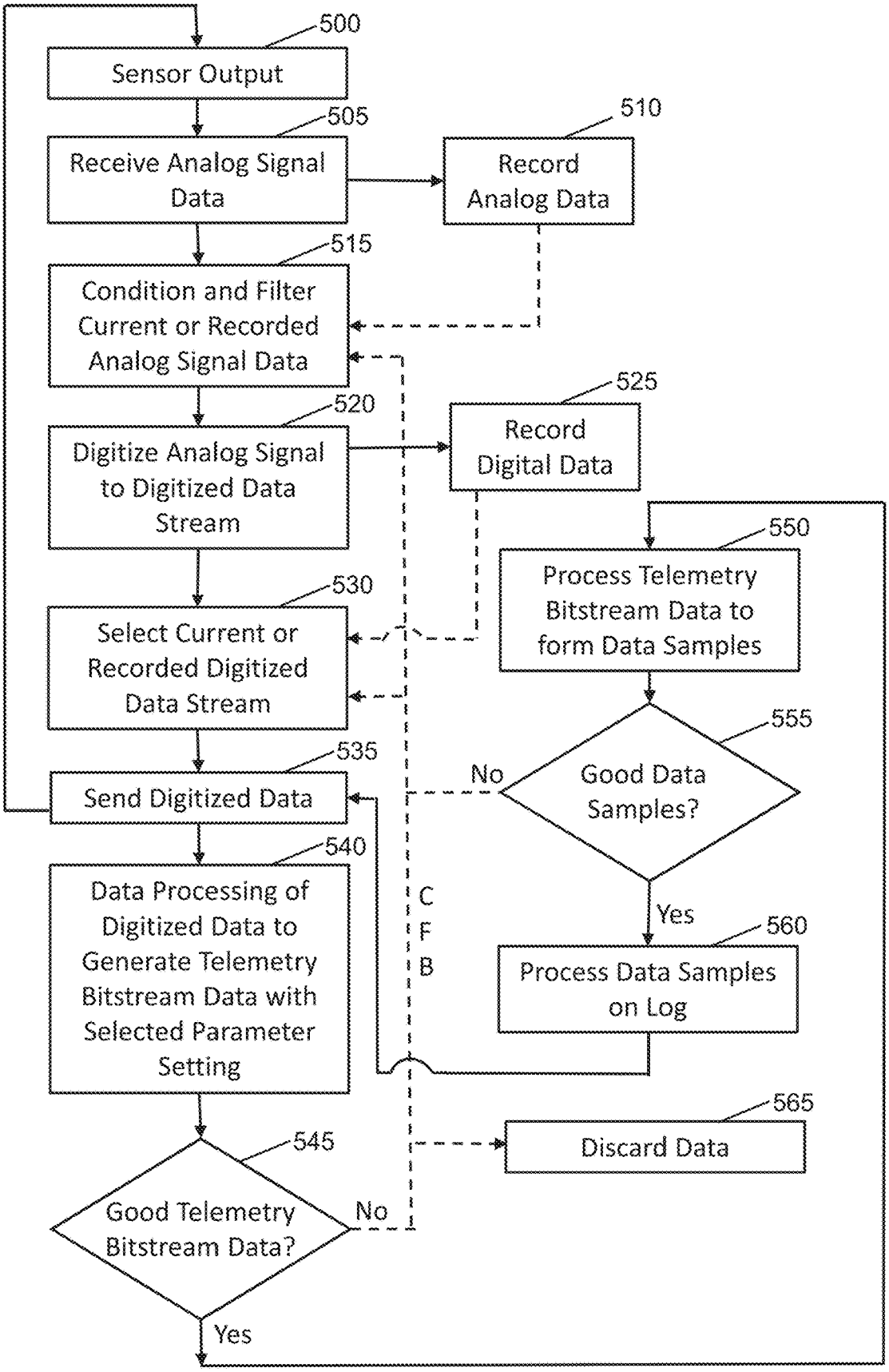
FIG. 5 is a flow chart illustrating aspects of the flow chart of FIG. 4.

FIG. 5 is a flow chart illustrating aspects of the flow chart of FIG. 4A. In step 500, a sensor, such as a pressure sensor but can be other types of sensors, can provide output as data to the system. In step 505, the sensor output can be received generally as an analog signal used for processing in the system. In step 510, for archival records and possible use as described herein, the analog signal data can be recorded. In step 515, the analog signal data can advantageously be processed prior to digitizing by conditioning and filtering for a cleaner signal. In step 520, the analog signal can be digitized into digitized data. Because the analog signal is providing sensor information generally in real time, the digitized data is in the form of a stream of time-based digitized data. In step 525, for records and possible use as described herein, the digitized data can be recorded.

In step 530, the digitized data can be sent through a selection step, described in more detail below, and in step 535, sent for data processing in step 540 to generate telemetry bitstream data using one or more parameters with one or more parameter settings. In step 545, a quality check can be performed on the telemetry bitstream data. In step 550, if the telemetry bitstream data has sufficient quality according to given criteria, the data can be processed into data samples. In step 555, another check can be performed to determine the quality of the data samples. In step 560, if the samples have sufficient quality according to given criteria, the data samples can be processed to form a log or other desired output. With the data satisfactorily processed, the system can loop back to obtain more digitized data for more data processing. In at least one embodiment, the loop is generally continuous (except for momentary for the continuous incoming sensor output. As known in the industry, the log noted in step 560 can be generated with reference to time or corresponding depth of the well. As the drilling progresses a measure of depth of the well is maintained at a corresponding time at regular intervals of time, also known as a timestamp. Most of the formation related measurements logs that geologist is interested are generally presented in depth log. Some drilling mechanics measurements which are useful for the drillers may be presented in time log.

However, if the quality check in step 545 indicates the telemetry bitstream data does not have sufficient quality, then in step 565, the system can discard such data, and in general, a control feedback ("CFB") can request the selection step 530 to send recorded prior data, instead of current new data, to attempt to correct the telemetry bitstream data or data samples and obtain sufficient quality data. The selection step 530 may through the control feedback choose to send recorded digital data or recorded analog data. If analog data, the data can again be conditioned and filtered, and digitized to send through the selection step to data processing.

The temporary selection and sending of prior recorded data can be many times faster than the data flow of ongoing current data. The system can process the prior recorded data while recording the current data, quickly catch up, and then switch back to sending current data. For example, the system can retrieve a relevant portion of the recorded digitized data and reprocess the retrieved data into another telemetry bitstream data, and check again for sufficient quality. It is expected that one or more parameter settings and perhaps one or more parameters will change for the processing of the recorded data to achieve sufficient quality. For example and without limitation, if the original parameter was to filter at the center frequency and the parameter setting was 1 Hz, the parameter setting could be changed to 2 Hz to determine if the telemetry bitstream data quality improves. Alternative, the parameter itself could be changed to knotch filter to reject electrical AC induced noise with a given parameter setting to determine if the telemetry bitstream data quality improves. The process can continue until sufficient quality is achieved or the system performs a sufficient number of iterations without being able to achieve a sufficient quality and stops on that portion of the data.

If desired (or if the digitized data and one or more parameters and their settings does not result in a sufficient quality), the recorded analog data can be retrieved, conditioned, and filtered perhaps with different settings, digitized into a stream of digitized data, and processed into telemetry bitstream data, perhaps with a changes in one or more parameter and/or settings, as described in the preceding paragraph.

A similar reprocessing of the digital and/or analog data can occur for the quality check on the data samples as described above for the quality check on the telemetry bitstream data. If the quality check shows the data samples does not have sufficient quality, the system can discard such data and for example, select recorded digitized data to be sent for data processing try to obtained sufficient quality data. The system can retrieve the relevant portion of the recorded digitized data, reprocess the portion into another telemetry bitstream data, and check again for sufficient quality. If the quality is sufficient, then the telemetry bitstream data can be processed into data samples, and checked for sufficient quality. Alternative, control feedback can elect to use recorded analog data, so that the analog data is conditioned and filtered, digitized, processed into telemetry bitstream data, and quality checked. If the quality is sufficient, then the telemetry bitstream data can be processed into data samples, and the data samples checked for sufficient quality.

It is understood that the process steps in FIG. 5 can apply to an embodiment with multiple channels such as shown and described in FIG. 4B as well. The data processing could occur with multiple parameters and/or multiple parameter settings to differentiate the channels. The best channel could be selected, the quality check for the best channel performed for data integrity, and if sufficient, then processed through the steps to obtain data samples with the subsequent quality check) for the log or other output. It is believed that the use of multiple channels can reduce the need for reprocessing with recorded data to develop sufficient quality data samples for an output.

If the data quality is insufficient, the telemetry bitstream data and/or data samples can be discarded, and the recorded data can be used with different parameters and/or settings to produce one or more channels with new telemetry bitstream data or data samples. The best channel from the different parameters and/or parameter settings can again be selected from the reprocessed channels with the revised parameters and/or parameter settings, and the selected channel with the reprocessed data can be checked for sufficient quality. Depending on the results, the process can proceed as described above.

An alternative embodiment is to select the best channel, determine portions of the selected channel have insufficient quality, and extract corresponding portions from the one or more other channels that have sufficient quality to repair the selected channel. The selected and repaired channel can be further processed to result in the data samples for the log or other output.

Figure 6A:
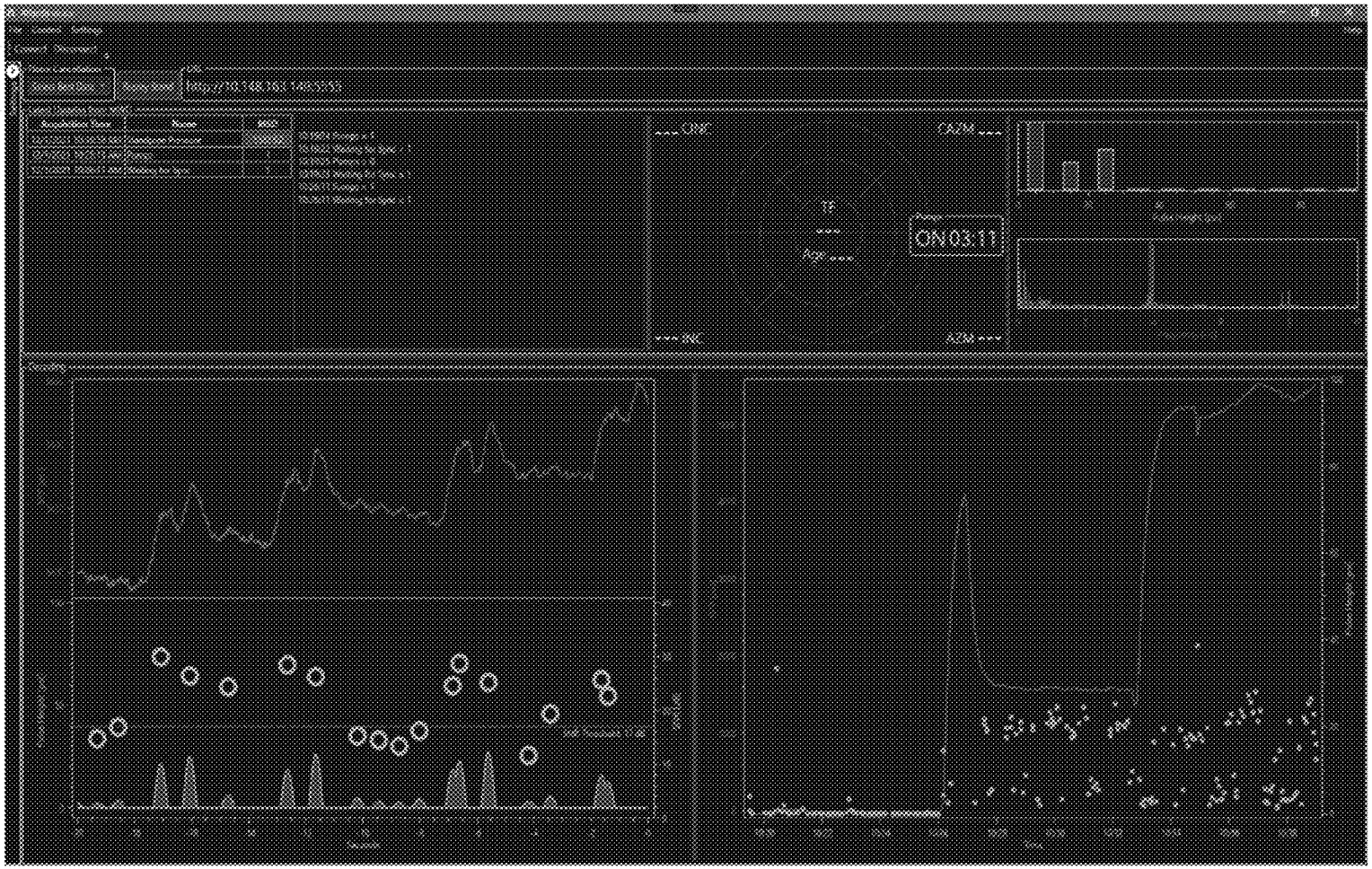
FIG. 6A is an exemplary screen shot of a human interface, illustrating an initial output of data using the invention.

FIG. 6A is an exemplary screen shot of a human interface ("HI") illustrating a display with an output of data using the invention. A lower right quadrant of the display shows a pressure waveform of SPP in the green color solid line. The display also shows blue dots, where each blue dot represents the pressure pulse detected by the surface computer processing software. These plots give a diagnostic visualization of the pressure waveform and processing results to the user. These pressures are plotted against the time reference on the X-axis. In this display, the view over a longer time period is shown to give a long-term view of the telemetry components.

In the lower left quadrant, the same SPP is shown in green solid line and the simulated blue pressure pulses are shown with the peak of each pulse is obtained by the processing software. These are the same waveforms as shown in the bottom right quadrant but highly zoomed-in on the time axis. The red circles represent the confidence level of bitstream produced by the processing software corresponding to each pulse representing a symbol containing one or more bits. This screen shot provides a detailed view of the telemetry functions to the user for diagnostic purposes.

The top right quadrant view also gives the user a better overall view of the function of the telemetry for primarily diagnostics purposes on a medium time frame. The green frequency plot with frequency on X-axis and amplitude on Y-axis shows the frequency response of the communication channel, in this case, drilling mud channel, frequency response to the telemetry signal transmitted from the telemetry tool along with various noise superimposed. The primary telemetry signal is shown in the low frequency very close to zero, DC. The large narrow spike in the middle of the plot is a noise which was superimposed on the telemetry pressure signal. As an example, the spike can come from the multiplex mud pumps operating in the system for mud flow. The other plot in blue in the same quadrant is showing the histogram of the pulse heights computed by the processing software.

In the top left quadrant, there are some settings, and the telemetry sample values are shown which are decoded from the computed bitstream by the processing software. Normally when all is working properly, a measurement sample and its value is periodically displayed here in an incrementing list form.

In this screen shot, the decoding is running, and pulses are coming in but it is clear that something is wrong. No sync is detected, and no data is coming in.

Figure 6B:
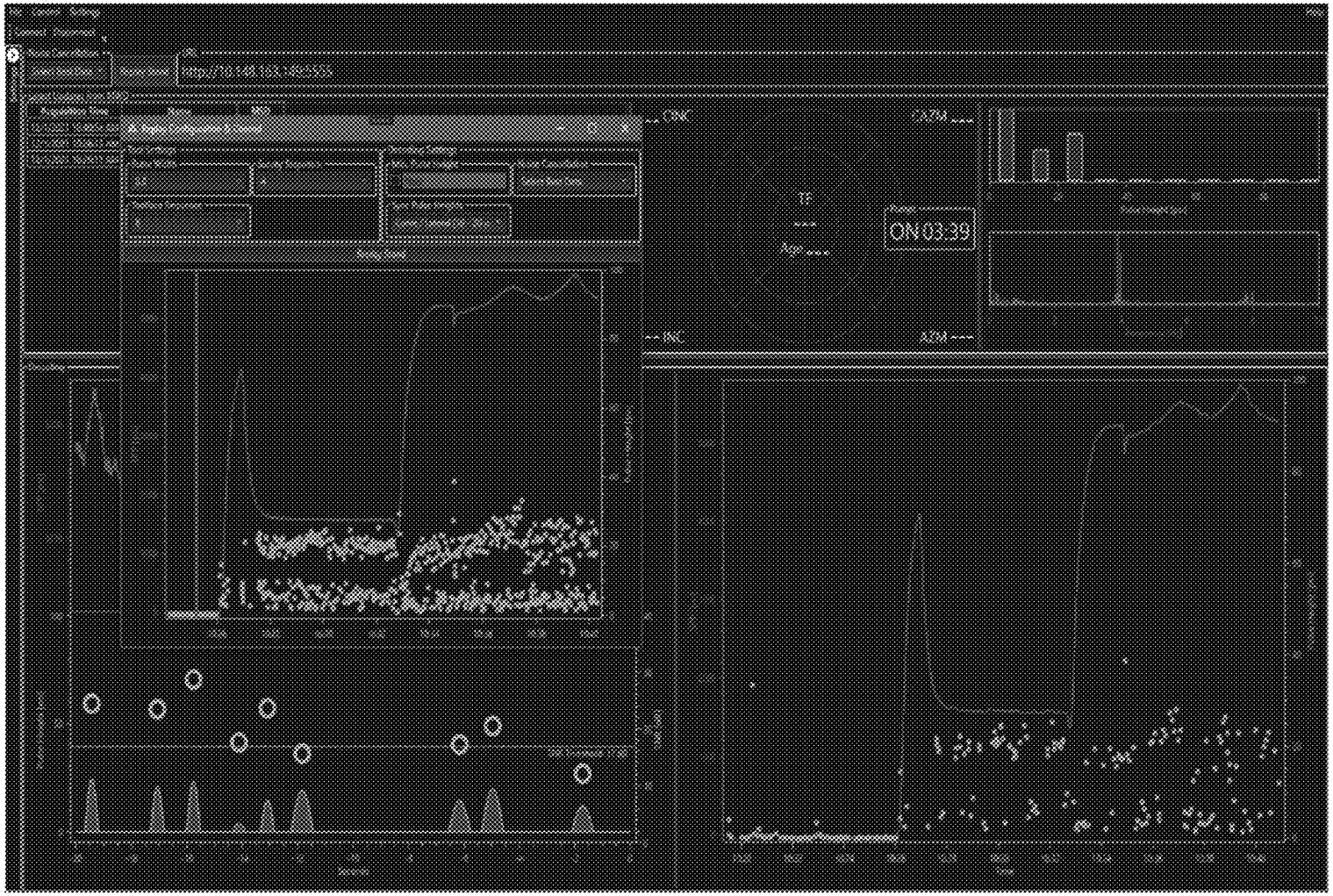
FIG. 6B is an exemplary screen shot of another page of the human interface, illustrating a selection of the recorded historical data of FIG. 6A to replay.

FIG. 6B is an exemplary screen shot of another page of the HI, illustrating a selection of the recorded historical data of FIG. 6A to replay. Once an issue is detected, the user can choose a selection to reply, here "Replay Stand", to cause a second screenshot to appear with a Replay Control Window. The user can adjust the decoding settings and select the Reply button to start the replay. One of the settings indicates start time, that is, at what time to start the Reply. As shown in this example, the user can drag the red line back to beginning of the stand just before the pumps were turned ON or other selected times on the chart, or other selected indicia as might be provided in various embodiments.

Figure 7:
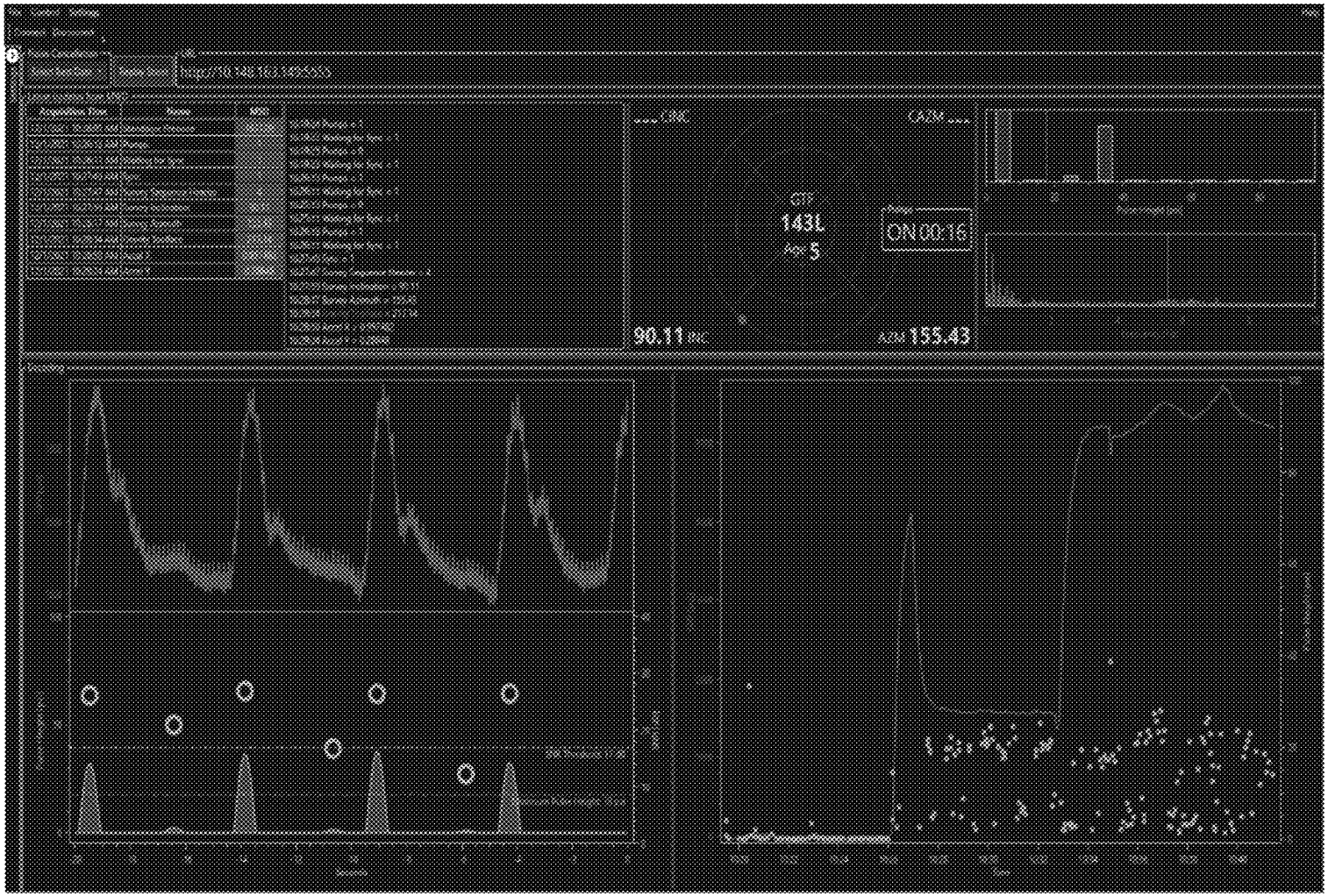
FIG. 7 is an exemplary screen shot of another page of the human interface, illustrating output from the replay of the recorded data selected in FIG. 6B.

FIG. 7 is an exemplary screen shot of another page of the HI display, illustrating output from the replay of the recorded data selected in FIG. 6B. The replay of the historical data with the new settings generates decoded data. The application will replay much faster than real time allowing the reply data to catch up with the most recently acquired pressure data.

Another example of an instance that can cause a situation of data loss is inadvertent change in the telemetry setting in the telemetry tool during adding a new stand in the drilling process. The telemetry and data received in the previous stand can be valid bitstream data. During adding the new stand, uncharacteristically, the pumps may need to be cycled ON and OFF several times due to difficulty on the rig. The pumps ON and Off sequence and timings can inadvertently be the sufficiently close to a downlink command transmission that resets reporting protocols of the telemetry tool, such as changing the telemetry pulse width. The user at the surface is unaware of the unintended transmission and the telemetry tool and the surface computer processing software have become out of synchronization.

Since the tool inadvertently received a command and changed its telemetry pulse width, the surface computer processing software does not find the SYNC in the pressure pulses signal received from the telemetry tool. Drilling may proceed by several feet of well and miss valuable information of the existence of a layer of hydrocarbon or other valuable resources. The user may suspect such as change as no other explanation can be found from all the diagnostic information available. In the field, the user can conduct trial-and-error experimenting with different pulse width at the surface computer by turning the pumps ON and OFF several times. Even if successful, the reconfiguration results in significant unproductive time and loss of drilling efficiency. In this case, the system can quickly reset the pulse-width detected by the system and reconfigure the parameter settings and reprocess the recorded data to get the high quality bitstream data and subsequent samples without losing any time of the drilling operation.

Other and further embodiments utilizing one or more aspects of the inventions described above can be devised without departing from the disclosed invention as defined in the claims.

For example, other embodiments can include other various parameters, formats, various numbers of channels, combined instruments fulfilling multiple functions, various input data points, and other variations than those specifically disclosed herein within the scope of the claims. While the description of a pressure transducer input for the digitized data has been used as a nonlimiting example, it is understood that other sensors can be used to provide input to be processed by the system.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intend to protect fully all such modifications and improvements that come within the scope of the following claims.

What is claimed is:

1. A method of providing telemetry data, comprising:

receiving a downhole telemetry analog signal from at least one sensor coupled to a well;

processing the analog signal into a digitized data stream;

recording at least one of the analog signal and the digitized data stream as recorded data;

processing the digitized data stream comprising evaluating at least one of a location, width, height, frequency, and waveform of the digitized data stream into a processed telemetry bitstream data;

replaying a portion of the recorded data for at least one of an identified telemetry bitstream data loss in the telemetry bitstream data; and reprocessing the portion of the recorded data to provide a data fill of the telemetry bitstream data loss in real time.

2. The method of claim 1, further comprising:

processing the telemetry bitstream data into data samples;

replaying a portion of the recorded data for at least one of an identified data sample loss; and reprocessing the portion of the recorded data for the at least one of the identified data sample loss to provide a data fill of the data sample loss in real time.

3. The method of claim 1, wherein the portion of the recorded data for replaying is selected by a user of the processed data.

4. The method of claim 1, wherein the portion of the recorded data for replaying is automatically selected by an electronic processer.

5. The method of claim 1, wherein the reprocessing the portion of the recorded data is performed with at least one different parameter setting of processing than a previous processing.

6. The method of claim 1, wherein the evaluating is performed by an electronic processor in real time.

7. The method of claim 1, further comprising providing at least one different parameter setting for reprocessing the portion of the recorded data to provide the data fill based on the evaluating at least one of the location, width, and the height of pulses in the telemetry bitstream data.

8. The method of claim 1, wherein reprocessing the portion of the recorded data to provide the data fill further comprises reapplying a real time log for the data fill with a timestamp of the portion of the recorded data prior to the reprocessing.

9. The method of claim 1, wherein reprocessing the portion of the recorded data to provide the data fill further comprises reapplying a real time log for the data fill with an associated depth of the portion of the recorded data prior to the reprocessing.

10. The method of claim 1, further comprising multiple processing channels configured to process in parallel for the processing the digitized data stream into multiple processed telemetry bitstream data, wherein at least two channels have at least one different parameter setting.

11. The method of claim 10, wherein one of the channels is selected for further processing into data samples.

12. The method of claim 1, further comprising multiple processing channels configured to process in parallel for the reprocessing the portion of the recorded data to provide a data fill of the telemetry bitstream data loss in real time, wherein at least two channels have at least one different parameter setting.

13. The method of claim 1, wherein the reprocessing the portion of the recorded data is performed with at least one different algorithm of processing than a previous processing.

14. A method of providing telemetry data, comprising:

a. receiving a downhole telemetry analog signal from at least one sensor coupled to a well;

b. processing the analog signal into a digitized data stream;

c. processing the digitized data stream into a first processed telemetry bitstream data with a first set of parameter settings; and d. processing the digitized data stream into a second processed telemetry bitstream data with a second set of parameter settings having at least one parameter setting different than the first set of parameter settings, wherein processing the digitized data stream in at least one of steps (c) and (d) comprises evaluating at least one of a location, width, height, frequency, and waveform of the digitized data stream.

15. The method of claim 14, wherein the processing the digitized data stream into the first processed telemetry bitstream data is concurrent with the processing the digitized data stream into the second processed telemetry bitstream data.

16. The method of claim 14, further comprising selecting one of processed telemetry bitstream data;

evaluating the selected processed telemetry bitstream data for any data loss; and selecting portions of another processed telemetry bitstream data to provide any data fills for any data losses in the selected telemetry bitstream data.

17. The method of claim 14, further comprising evaluating the first processed telemetry bitstream data and the second processed telemetry bitstream data;

selecting the processed telemetry bitstream data with the least data loss; and selecting portions of at least one of the other processed telemetry bitstream data to provide any data fills for any data losses in the selected telemetry bitstream data.

18. The method of claim 14, further comprising recording at least one of the analog signal and the digitized data stream as recorded data.

19. A telemetry data system, comprising:

a processor; and a non-transitory computer readable medium including processor executable instructions that, when executed, cause the telemetry data system to perform operations, comprising:

receiving a downhole telemetry analog signal from at least one sensor coupled to a well;

processing the analog signal into a digitized data stream;

recording at least one of the analog signal and the digitized data stream as recorded data;

processing the digitized data stream comprising evaluating at least one of a location, width, height, frequency, and waveform of the digitized data stream into a processed telemetry bitstream data;

replaying a portion of the recorded data for an identified telemetry bitstream data loss in the telemetry bitstream data; and reprocessing the portion of the recorded data to provide a data fill of the telemetry bitstream data loss in real time.

20. The system of claim 19, wherein the processing the digitized data stream into the processed telemetry bitstream data further comprises processing the digitized data stream into multiple channels of telemetry bitstream data, wherein at least two channels have at least one different parameter setting.

21. The method of claim 19, wherein the reprocessing the portion of the recorded data is performed with at least one different algorithm of processing than a previous processing.

22. A telemetry data system, comprising:

a processor; and a non-transitory computer readable medium including processor executable instructions that, when executed, cause the telemetry data system to perform operations, comprising:

a. receiving a downhole telemetry analog signal from at least one sensor coupled to a well;

b. processing the analog signal into a digitized data stream;

c. processing the digitized data stream into a first processed telemetry bitstream data with a first set of parameter settings; and d. processing the digitized data stream into a second processed telemetry bitstream data with a second set of parameter settings having at least one parameter setting different than the first set of parameter settings, wherein processing the digitized data stream in at least one of steps (c) and (d) comprises evaluating at least one of a location, width, height, frequency, and waveform of the digitized data stream.

23. A method of providing telemetry data, comprising:

receiving a downhole telemetry analog signal from at least one sensor coupled to a well;

processing the analog signal into a digitized data stream;

recording at least one of the analog signal and the digitized data stream as recorded data;

processing the digitized data stream into a processed telemetry bitstream data;

processing the telemetry bitstream data into data samples;

replaying a portion of the recorded data for at least one of an identified data sample loss in the telemetry bitstream data; and reprocessing the portion of the recorded data to provide a data fill of the data sample loss in real time.

24. The method of claim 23, wherein the reprocessing the portion of the recorded data is performed with at least one different algorithm of processing than a previous processing.

* * * * *